US005159325A

United States Patent [19]

Kuijk et al.

[11] Patent Number: 5,159,325

[45] Date of Patent: Oct. 27, 1992

[54] METHOD OF DRIVING A DISPLAY DEVICE

[75] Inventors: Karel E. Kuijk, Eindhoven, Netherlands; Alan G. Knapp, Crawley; John M. Shannon, Whyteleafe, both of United Kingdom

[73] Assignee: U.S. Philips Corporation, New York, N.Y.

[21] Appl. No.: 414,565

[22] Filed: Sep. 29, 1989

Related U.S. Application Data

[63] Continuation-in-part of Ser. No. 208,185, Jun. 16, 1988, Pat. No. 5,032,831.

[30] Foreign Application Priority Data

Oct. 5, 1988 [NL] Netherlands ..... 8802436

[51] Int. Cl.[5] ..... G09G 3/34; G09G 3/00

[52] U.S. Cl. ..... 340/783; 340/805; 340/811

[58] Field of Search ..... 340/783, 784, 805, 811, 340/719; 350/332, 333, 334; 358/236; 359/53, 54, 55, 58, 60

[56] References Cited

U.S. PATENT DOCUMENTS

| | | | |
|---|---|---|---|
| 3,654,606 | 4/1972 | Marlowe et al. | 340/784 |
| 4,251,136 | 2/1981 | Miner et al. | 340/719 |
| 4,393,380 | 7/1983 | Hosokawa et al. | 340/719 |
| 4,583,087 | 4/1986 | van de Venne | 340/719 |
| 4,748,445 | 5/1988 | Togashi et al. | 340/784 |
| 4,794,385 | 12/1988 | Kuijk | 340/784 |
| 4,810,059 | 3/1989 | Kuijk | 340/784 |
| 4,932,759 | 6/1990 | Toyono et al. | 340/784 |
| 4,945,352 | 7/1990 | Ejiri | 340/784 |
| 4,955,697 | 9/1990 | Tsukada et al. | 340/784 |
| 4,958,152 | 9/1990 | Kuijk et al. | 340/784 |
| 5,032,831 | 7/1991 | Kuijk | 340/784 |

*Primary Examiner*—Ulysses Weldon
*Assistant Examiner*—M. Fatahi Yar
*Attorney, Agent, or Firm*—Robert J. Kraus

[57] ABSTRACT

In a picture display device with pixels (12) which are driven via active elements (15), non-uniformities in the electrical behaviour of the active elements are obviated by driving the device in a reset mode.

14 Claims, 3 Drawing Sheets

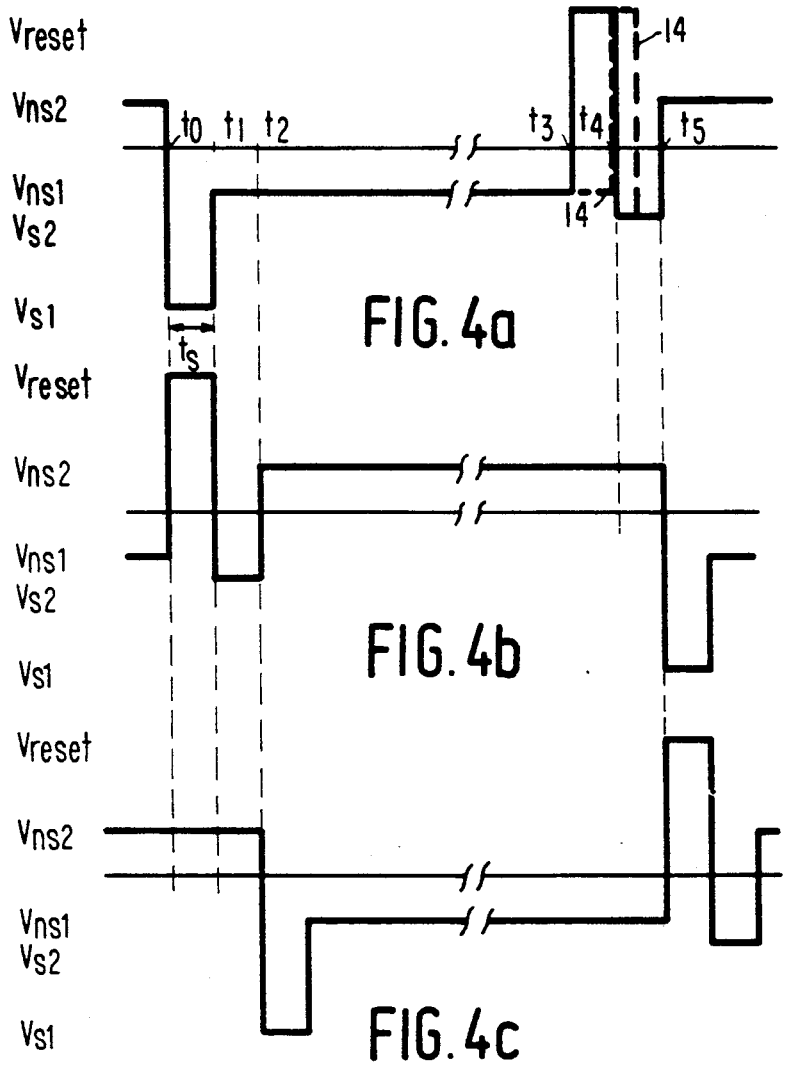
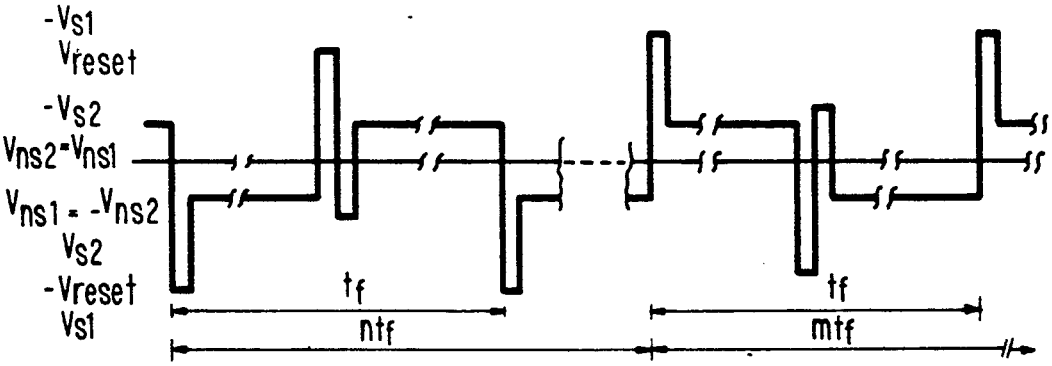
FIG. 5

METHOD OF DRIVING A DISPLAY DEVICE

CROSS REFERENCE TO RELATED APPLICATION

This application is a continuation-in-part of U.S. Patent Application Ser. No. 208,185 filed on Jun. 16, 1988, (Now U.S. Pat. No. 5,032,831)

BACKGROUND OF THE INVENTION

The invention relates to a method of driving a display device comprising an electro-optical display medium between two supporting plates, a system of pixels arranged in rows and columns, with each pixel being at least formed by picture electrodes arranged on the facing surfaces of the supporting plates, at least one picture electrode being connected to a row or column electrode via a non-linear switching element, a row of pixels being selected by means of the switching elements via the row electrodes during at least a part of a line period, while data signals are presented via the column electrodes.

In this respect it is to be noted that the terms row electrode and column electrode in this application may be interchanged if desired, so that a column electrode may be meant where reference is made to a row electrode while simultaneously changing column electrode to row electrode.

In the Netherlands Patent Application No. 8,701,420 (corresponding to U.S. Pat. No. 5,032,831) in the name of the Applicant, a method of the type described in the opening paragraph is described, which provides a wide choice of freedom in the colour filters to be used. This is possible by giving the pixels a given adjustment per row by charging or discharging the capacitances associated with these pixels after first having discharged or charged them too far (either accurately or not).

In said Application this is realised by applying, prior to selection, an auxiliary voltage across the pixels beyond or on the limit of the voltage range to be used for picture display, for example an auxiliary voltage (reference voltage) or reset voltage.

In a preferred embodiment of the device described in this Application a zener diode is arranged between a pixel and a row or column electrode.

Such a zener diode has a strong asymmetrical current-voltage behaviour (IV-curve).

SUMMARY OF THE INVENTION

A method according to the invention is characterized in that the switching element is substantially symmetrical and in that prior to presenting a selection signal, which together with the data signals provides the pixels with a pixel voltage of a certain voltage sign, the pixels are charged or discharged by means of the switching elements to an auxiliary voltage of said same voltage sign, the auxiliary voltage lying beyond or on the limit of the range to be used for picture display. The auxiliary voltage is preferably beyond or on the limit of the range of transition in the transmission/voltage characteristic of the electro-optical medium.

A preferential embodiment of a method according to the invention is characterized in that at least during a number of successive selections, whether preceded by charging or discharging the pixels to an auxiliary voltage or not the current through the symmetrical switching elements has the same direction.

In this connection substantially symmetrical switching elements are understood to mean switching elements which have the same or approximately the same current-voltage variation (with opposite sign for current and voltage) such as, for example a MIM (metal-isolator-metal) when reversing the voltage. A completely identical variation in both directions is often made substantially impossible by the manufacturing method, in practice the current-voltage curves of such symmetrical switching elements have substantially the same shape in both directions and the on and off voltages in the positive part of the characteristic curve (with the exception of the sign) differ only little from those in the negative part, in contrast to, for example zener diodes. Other examples of symmetrical switching elements are, for example back-to-back diodes and certain semiconductor switching elements such as a nin switching element or a pip switching element (alternately comprising an n (p)-doped semiconductor region, a substantially intrinsic semiconductor region and an n (p)-doped semiconductor region).

The symmetrical behaviour can also be obtained by means of a combination of sub-switching elements such as one or more diode rings, a combination of the above-mentioned switching elements, or otherwise.

Viewed over the entire display device, the switching elements may have a considerable spread in, for example the forward voltage so that unwanted voltage components may be introduced resulting in non-uniformities (grey variations) occurring in the display device when conventionally driving the rows with periodic inversion of the polarity of both the selection signals and the non-selection signals (simultaneously with that of the data signals). It is found that these voltage components can be compensated for when used in the method according to the invention in such a way that they hardly influence or do not influence the voltage determining the transmission of the liquid crystal.

BRIEF DESCRIPTION OF THE DRAWINGS

Embodiments of the invention will now be described in greater detail with reference to the accompanying drawings in which:

FIGS. 4*a*, 4*b* and 4*c* show the drive signals associated with a method according to the invention and FIG. 5 shows a modification.

DETAILED DESCRIPTION OF AN EMBODIMENT OF THE INVENTION

Figure 1A:
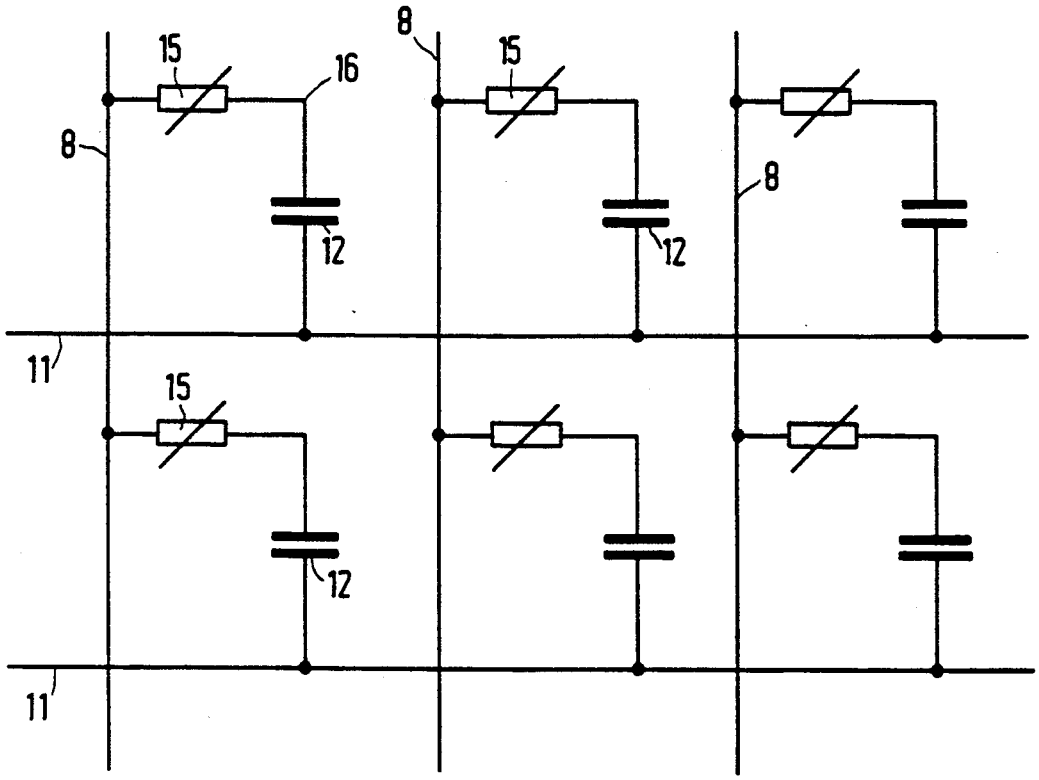
FIGS. 1*a* and 1*b* show diagrammatically a picture display device for use of a method according to the invention.

FIG. 1*a* shows diagrammatically a device for use of a method according to the invention. Pixels 12 arranged in a matrix are located at the area of crossings of row electrodes 11 and column electrodes 8, while the pixels are connected to the column electrodes 8 via symmetrical non-linear switching elements 15, in this example MIMs.

Figure 2:
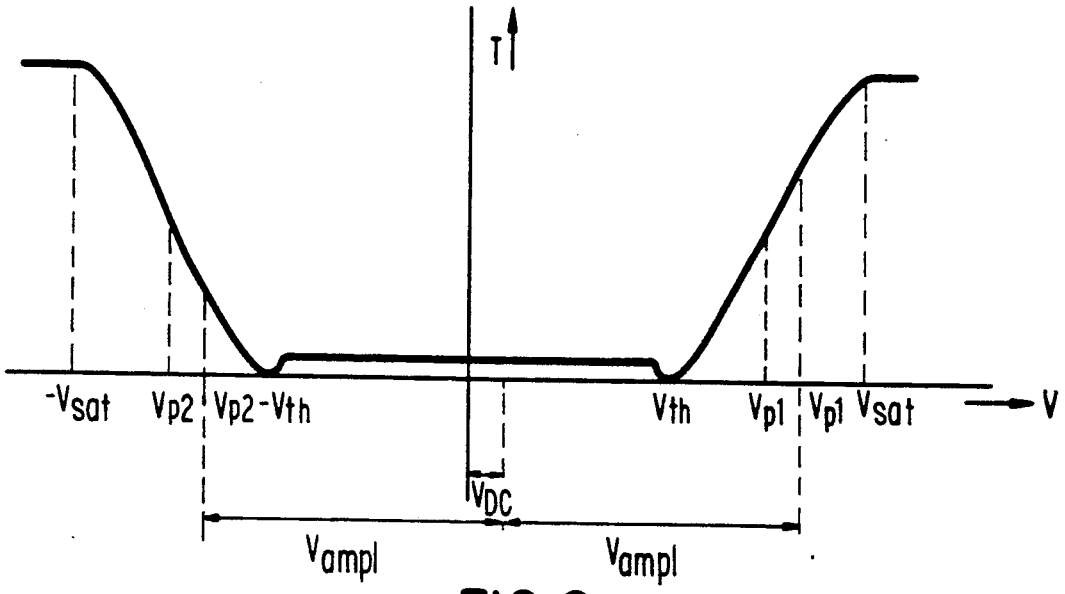
FIG. 2 shows the transmission/voltage characteristic of an electro-optical medium, for example a liquid crystal.
Figure 3:
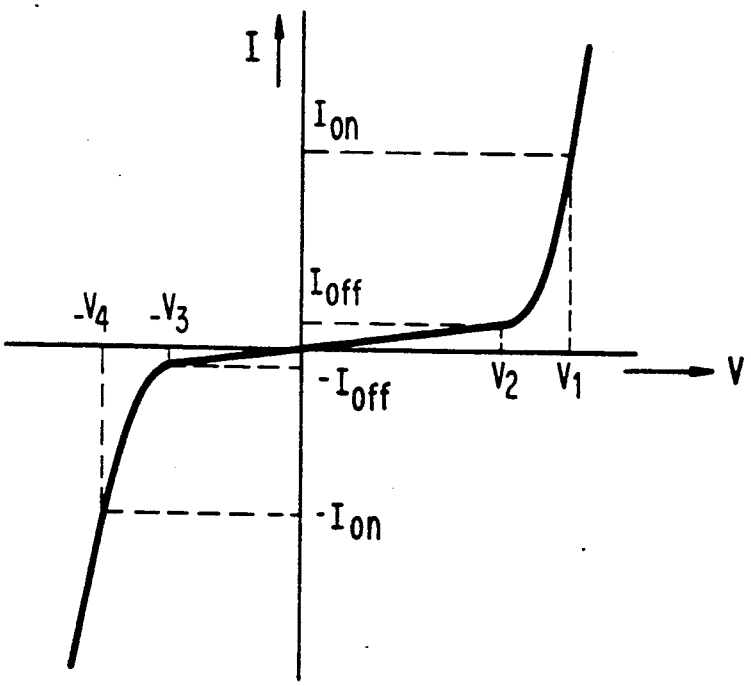
FIG. 3 shows diagrammatically the current-voltage characteristic of a substantially symmetrically non-linear switching element (for example a MIM)

If a data voltage Vd is presented to a column electrode 8, while a selection voltage Vs1 is presented to a selected row electrode 11, it holds for a selected pixel 12 that the voltage across this pixel, i.e. the pixel voltage Vp1 (see FIG. 2) is equal to:

$$Vp1 = Vd - Vs1 - Vm \quad (1)$$

in which Vm is the forward voltage of the MIM which supplies sufficient current to charge the pixel to the correct voltage within the desired period of time.

In a subsequent field the data voltage is presented in an inverted manner (−Vd) while the selection voltage is now Vs2. Since, as will be described hereinafter, the capacitance associated with the pixel 12 has first been negatively charged too far in a manner analogous to that described in the Netherlands Patent Application 8,701,420 U.S. Ser. No. 208,185 filed Jun. 16, 1989, it is charged again while the current through the MIM has the same direction so that the pixel voltage Vp2 (see FIG. 2) is now equal to:

$$Vp2 = -Vd - Vs2 - Vm \quad (2)$$

It follows from (1) and (2) that:

$$Vp1 - Vp2 = 2Vd - Vs1 + Vs2 = 2Vampl \quad (3)$$

$$Vp1 + Vp2 = -Vs1 - Vs2 - 2Vm = 2V_{DC} \quad (4)$$

In the ideal case (no spread in the voltage Vm, completely symmetrical transmission/voltage characteristics) the pixel voltage in the case of equal but opposite data voltage Vd and −Vd is also equal but has an opposite sign, provided that it holds for the selection voltages Vs1, Vs2 that Vs2 = −Vs1 − 2Vm. Then it holds that Vp1 = −Vp2 = Vampl. Simultaneously $V_{DC}=0$.

The same pixel voltages Vp1, Vp2 can also be written as:

$$Vp1 = \tfrac{1}{2}(Vp1 + Vp2) + \tfrac{1}{2}(Vp1\,Vp2) = V_{DC} + Vampl \quad (5)$$

$$Vp2 = \tfrac{1}{2}(Vp1 + Vp2) - \tfrac{1}{2}(Vp1 - Vp2) = V_{DC} - Vampl \quad (6)$$

The DC component $V_{DC}$ which may be introduced by the fact that the MIM voltage Vm (or that of another approximately symmetrical switching element) is not identical throughout the surface of the display device and which results in a deviation of the voltage drop across an arbitrary MIM from the nominal value Vm appears to be compensated in practice by a movement of ions in the liquid crystal material so that after some time a direct voltage is only present over the insulating (orientation) layer covering the electrodes. The effective pixel voltage V*p is now determined by the (periodically changing) voltage Vampl. For this it holds that:

$$V^*p1 = -V^*p2 = Vampl \text{(see FIG. 2)}$$

Even if the compensation does not occur, the effective voltage $Veff = V^2ampl + V^2_{DC}$ deviates to a small extent from the desired value Vampl across two fields at an average, provided that $|V_{DC}| << |Vampl|$, which can be quite well realised in practice. To inhibit possible disintegration of the liquid crystal due to this small remaining DC voltage, the sign of all operating voltages may be changed periodically.

The voltage Vampl is independent of the voltage drop across the MIM and possible variations therein. Variations due to non-uniform switching behaviour of the switching elements are therefore not found or are hardly found in the transmission behaviour of the device because possible DC components are compensated for. These DC components are independent of the data voltages (see (4)) so that no image retention or ghost pictures occur.

For writing information a first selection voltage Vs1 is presented on a selection line 11 during a selection period $t_s$ while the information or data voltages $V_d$ are simultaneously presented on the column electrodes 8; this leads to, for example a positive voltage across a pixel 12 which represents the information presented.

To prevent degradation of the liquid crystal and to be able to increase the so-called face flicker frequency, information having an alternating sign is preferably presented across the pixel 12. In the method according to the invention a negative voltage across the pixel 12, which represents the information presented, is achieved by presenting a second selection voltage Vs2 while simultaneously presenting inverted data voltages (−Vd) after having discharged the capacitance associated with the pixel 12 too far (or after having negatively charged it too far) via the MIM 15.

FIG. 4 shows how the drive signals are chosen for a plurality of rows of pixels 12 in order to write them with picture information which changes sign during each field (for example in TV applications).

From the instant t0 (see FIG. 4*a*) a selection voltage Vs1 is presented on a row electrode 11 during a selection period ts (which in this example is chosen to be equal to a line period for TV applications, namely 64 μsec) while information voltages or data voltages Vd are simultaneously presented on the column electrodes 8. After the instant t1 the associated row of pixels 12 is no longer selected because the row electrode 11 receives a voltage Vns1. This voltage is maintained until just before the next selection of the row of pixels 12. In this example this is effected by presenting a reset voltage on the relevant row electrode 11 just before again selecting the first row of pixels 12, namely at an instant t3 = tf − ts, in which tf represents a field period. The reset voltage can then be chosen to be such that the pixels 12 are charged negatively to such an extent via the MIM 15 that the voltage across each associated pixel lies beyond the range to be used for picture display (up to a value of ≦ −Vsat). In a subsequent selection period (from t4) they are then charged to the desired value determined by data voltages −Vd, via the MIM. To this end the row electrodes receive the voltage Vs2 and after the selection period (after t5) has elapsed, they receive a non-selection voltage Vns2. In this way the voltage across the pixels is inverted during each field period.

FIG. 4*b* shows the same voltage variation as FIG. 4*a* but is then shifted over a field period plus a selection period (in this case a line period). This provides the possibility of writing two successive rows of pixels with inverse data voltages with respect to each other. FIG. 4*c* is identical to FIG. 4*a*, but is shifted over two selection periods.

For (television) pictures with half the vertical resolution in which the lines of the even and the odd field are written over each other, it is achieved that the picture information changes its sign and is refreshed once per field period. Although the line flicker frequency is 25 Hz (30 Hz) in this case, a face flicker frequency of 50 Hz (60 Hz) is achieved between successive rows due to the phase difference of 180° introduced by changing the sign per row.

The selection voltages Vs1 and Vs2 may of course also be chosen to be shorter than one line period (64 μsec). In this case the reset voltage may alternatively be presented during a part of the line period in which selection takes place, provided there is sufficient time left to charge the pixels 12. The voltage variation on the electrodes 11 is then effected, for example in the way as is shown diagrammatically in FIG. 4*a* by means of the broken line 14.

The device shown is very suitable for using a drive method in which $$Vc = \frac{Vsat + Vth}{2} \text{ and } -Vc = -\left(\frac{Vsat + Vth}{2}\right)$$

are chosen for the average voltage across a pixel (see FIG. 2) so that the absolute value of the voltage for the purpose of picture display across the pixels 12 is substantially limited to the range between Vth and Vsat.

A satisfactory operation as regards grey scales is obtained if, dependent on the data voltages Vd on the column electrodes 8, the voltage values across the pixels 12 are at most Vc+Vdmax=Vsat and at least Vc−Vdmax=Vth. Elimination of Vc yields:

$$|Vdmax| = \tfrac{1}{2}(Vsat - Vth), \text{i.e.:} \quad (1)$$

$$-\tfrac{1}{2}(Vsat - Vth) \leqq Vdmax \leqq \tfrac{1}{2}(VSat - Vth). \quad (2)$$

In order to charge a row of pixels 12, for example, positively, the associated row electrode 11 is given a selection voltage Vs1=−V1−½(Vsat+Vth) in which V1 is the forward voltage of the MIM 15. The voltage across the pixel 12 is therefore Vd−V1−Vs1; it ranges between $$-\tfrac{1}{2}(Vsat - Vth) + \tfrac{1}{2}(Vsat + Vth) = Vth \quad (3)$$

and $$\tfrac{1}{2}(Vsat - Vth) + \tfrac{1}{2}(Vsat + Vth) = V_{sat} \quad (4)$$

dependent on Vd.

In order to negatively charge the same row of pixels 12 (in a subsequent field or frame period) at a subsequent selection with inverted data voltages, these are first charged negatively too far by means of a reset voltage Vreset on the row electrode 11. Subsequently the selected row electrode receives a selection voltage Vs2=−V1+½(Vsat+Vth) (in the same line period or in a subsequent period). The pixels 12 which are negatively charged too far are now charged via the MIM 15 to −Vd−V1−Vs2, that is to say, to values between:

$$\tfrac{1}{2}(Vsat - Vth) - \tfrac{1}{2}(Vsat - Vth) = -Vth \quad (5)$$

and $$-\tfrac{1}{2}(Vsat - Vth) - \tfrac{1}{2}(Vsat - Vth) = -Vsat \quad (6)$$

so that information with the opposite sign is presented across the pixels 12.

In the case of non-selection the requirement must be satisfied that the MIMs 15 cannot conduct, or convey such a low current Ioff that discharge via the MIMs 15 is substantially negligible.

For a lowest non-selection voltage Vns1 it holds that the voltage $V_A$ at the junction 16 ranges between the values:

$$V_{Amin} = Vns1 + Vth \quad (7)$$

and $$V_{Amax} = Vns1 + Vsat \quad (8)$$

For the values $V_{Amin}$ and $V_{Amax}$ it holds that:

$$V_{Amax} \leqq -Vdmax + V3 \quad (9)$$

in which −V3 is the voltage at which charging via the MIM is substantially negligible.

To prevent discharge via the MIM 15, it also holds that:

$$V_{Amin} \geqq Vdmax - V2 \quad (10)$$

in which V2 is the voltage at which the current in the other direction is substantially negligible.

The equations (7) and (10) lead to:

$$+Vdmax - V2 \leqq Vns1 + Vth$$

or (with Vdmax=½(Vsat−Vth))

$$Vns1 \geqq +\tfrac{1}{2}(Vsat - Vth) - V2 - Vth \quad (11)$$

The equations (8) and (9) similarly lead to:

$$-Vdmax + V3 \geqq Vns1 + Vsat$$

or $$Vns1 \leqq -\tfrac{1}{2}(Vsat - Vth) - Vsat + V3 \quad (12)$$

Combination of (11) and (12) leads to:

$$-\tfrac{1}{2}(Vsat - Vth) - Vsat + V3 \geqq Vns1 >$$

$$\tfrac{1}{2}(Vsat - Vth) - V2 - Vth \quad (13)$$

or $$V2 + V3 \geqq 2(Vsat - Vth) \quad (14)$$

The pixels 12 are subsequently discharged to a value ≦−Vsat (see FIG. 4*a*) by giving the row electrode 11 a sufficiently high reset voltage. For this it holds that:

$$Vreset \div Vdmax + Vsat + V4$$

in which −V4 is the voltage of the MIM 15 in the other direction at which sufficient conductance occurs, or $$Vreset \geqq \tfrac{1}{2}(Vsat - Vth) + Vsat + V4 \quad (15)$$

Subsequently the pixels are accurately charged via the MIMs 15. For this purpose a selection voltage $V_{S2}$=½(Vsat+Vth)−V1 is presented on the row electrode 11 while simultaneously presenting data voltages on the column electrodes 8.

Subsequently the row electrode 11 receives a non-selection voltage Vns2. For the voltages at the junction 16 it now holds that:

$$V_{Amax} = Vns2 - Vth \text{ and } V_{Amin} = Vns2 - Vsat$$

With the equations (3) and (4) and $Vdmax=\frac{1}{2}(-Vsat-Vth)$ this leads to:

$$Vns2 \leqq -Vdmax+V3+Vth=-\tfrac{1}{2}(-Vsat-Vth)+Vth+V3 \quad (16)$$

and $$Vns2 \geqq Vdmax-V2+Vsat=+\tfrac{1}{2}(Vsat-Vth)-V2+-Vsat \quad (17)$$

Combination of (16) and (17) leads to:

$$\tfrac{1}{2}(Vsat-Vth)-V2+V_{sat} \leqq$$

$$Vns2 \leqq -\tfrac{1}{2}(Vsat-Vth)+Vth+V3 \quad (18)$$

so that it holds again that:

$$V2+V3 \geqq 2(Vsat-Vth) \quad (14)$$

To limit the number of drive levels, it may be desirable to use only one non-selection voltage Vns.

Combination of the equations (7) and (12) then yields $$\tfrac{1}{2}(Vsat-Vth)+Vsat-V2 \leqq Vns \leqq$$

$$-\tfrac{1}{2}(Vsat-Vth)-Vsat+V3 \quad (19)$$

In this case it holds that:

$$V2+V3 \geqq 3Vsat-Vth \quad (20)$$

The invention is of course not limited to the example described hereinbefore, but it may alternatively be used in devices comprising different non-linear substantially symmetrical switching elements such as a back-to-back diode, a nin or a pip switching element.

Figure 1B:
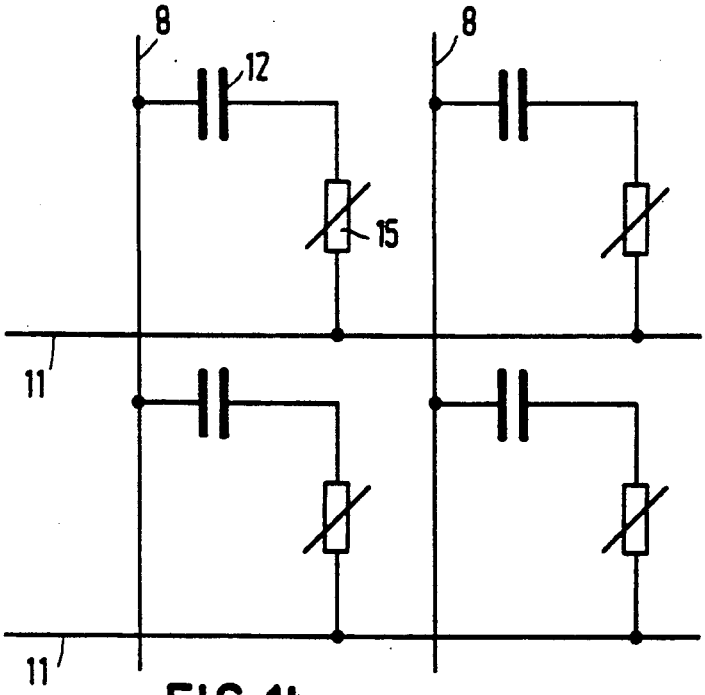

The switching element and the display element may also exchange positions as is shown diagrammatically in FIG. 1*b*.

A non-linear substantially symmetrical switching element may alternatively be assembled from different sub-switching elements as in the case of one or more diode rings or when providing redundancy, in a manner similar to that described in Netherlands Patent Application no. 8,800,204 (U.S. Pat. No. 4,994,796, issued on Feb. 19, 1991.

As already stated in the opening paragraph, possible degradation of the liquid crystal due to a remaining DC voltage can be avoided by periodically changing the sign of the operating voltages. To reduce possible other detrimental effects of unilateral resetting, with the non-linear switching element always conducting in one direction (for example, electron migration in Schottky diodes), it may be advantageous to periodically change the sign of all operating voltages, for example after each frame or after a fixed number of frames. This is shown diagrammatically in FIG. 5 in which firstly the drive is effected with the drive voltages during n frame periods $t_f$ ($n \geqq 1$), as derived hereinbefore (with one non-selection voltage Vns) and subsequently with inverse drive voltages during m frame periods ($m \geqq 1$). The inversion need not take place at periodical instants. For practical considerations a periodical inversion will generally be preferred, where n and m are at least 10.

The row electrodes need not be connected directly to the picture electrodes but they may be capacitively coupled thereto, as has been described in greater detail in the Netherlands Patent Application no. 8,802,155 (corresponding to allowed U.S. patent application Ser. No. 397,148 filed on Aug. 22, 1989) in the name of the Applicant.

An extra (storage) capacitance may be arranged parallel to the pixel between the column electrode and the row electrode.

Moreover, prior to selection at $t_o$ in FIG. 4*a* a second reset voltage can be presented to the row electrode 11 which in a manner known per se charges the pixels to an auxiliary voltage of a signl opposite to the voltage sign obtained during the selection period following immediately thereafter. To obtain uniform charging or discharging it may be advantageous to keep the data signals at zero Volt both during reset as described with reference to FIG. 4 and during charging or discharging by means of said second reset voltage.

We claim:

1. A method of driving a display device comprising an electro-optical display medium disposed between first and second supporting plates and including row and column electrodes, said device including a plurality of pairs of opposing first and second pixel electrodes arranged on the supporting plates, each of said pairs of electrodes defining a respective pixel in the medium and being electrically connected to respective ones of the row and column electrodes for applying additive selection and data voltages to select and drive, respectively, selected ones of the pixels to predefined states of transmissivity, characterized in that for each of said selected pixels the application of said selection and drive voltages effects, in sequence:

a. charging of the pixel to an auxiliary voltage of predetermined sign and magnitude through a respective, substantially symmetrical switching element which is electrically connected to one of the electrodes of the pixel; and b. charging of the pixel through the substantially symmetrical switching element from the auxiliary voltage to a voltage of the same sign but of lesser magnitude at which said predefined state of transmissivity is effected.

2. A method as in claim 1 where, during successive selections, each of said selected pixels is charged to predetermined voltages at which said predefined state of transmissivity is effected by passing current in the same direction through the substantially symmetrical switching element.

3. A method of driving a display device comprising an electro-optical display medium disposed between first and second supporting plates and including row and column electrodes, said device including a plurality of pairs of opposing first and second pixel electrodes arranged on the supporting plates, each of said pairs of electrodes defining a respective pixel in the medium and being electrically connected to respective ones of the row and column electrodes for applying additive selection and data voltages to select and drive, respectively, selected ones of the pixels to predefined states of transmissivity, characterized in that for each of said selected pixels the application of said selection and drive voltages effects, in sequence:

a. the passage of a current in a first direction through a respective, substantially symmetrical switching element which is electrically connected to one of the electrodes of the pixel, to charge the pixel to a first voltage Vp1 having a predetermined sign and a magnitude at which said predefined state of transmissivity is effected;

b. the passage of a current in a second direction, opposite to the first direction, through the substantially symmetrical switching element, to charge the pixel to an auxiliary voltage having the same sign as a second voltage Vp2 but a substantially greater magnitude than Vp2; and c. the passage of a current in the first direction through the substantially symmetrical switching element to charge the pixel to the second voltage Vp2, said second voltage having a polarity opposite to that of Vp1 and effecting said predefined state of transmissivity.

4. A method as in claim 3 where $Vp1=Vd-Vs1-Vm$ and where $Vp2=-Vd-Vs2-Vm$, Vd being the magnitude of the data voltage, Vm being the magnitude of a voltage drop across the substantially symmetrical switching element, Vs1 being the magnitude of a first selection voltage, and Vs2 being the magnitude of a second selection voltage.

5. A method as in claim 1, 2, 3 or 4 where, during charging the pixels to the auxiliary voltage, the data voltage has a magnitude of approximately zero volts.

6. A method as in claim 1, 2, 3 or 4 where the magnitude of the auxiliary voltage is approximately equal to a maximum operating voltage of the electro-optical display medium.

7. A method as in claim 1 or 2 where said pixels are arranged in rows and columns and where said sequential charging steps occur in a line selection period during which a row of the pixels is selected.

8. A method as in claim 1 or 2 where said pixels are arranged in rows and columns and where the selected pixels are charged to the auxiliary voltage during a line selection period preceding a line selection period during which said selected pixels are charged to the voltage of lesser magnitude.

9. A method as in claim 1, 2, 3 or 4 where the substantially symmetrical switching elements electrically connected to respective pixel electrodes comprise at least one of a metal-isolator-metal element, a back-to-back diode element, a nin switching element, and a pip switching element.

10. A method as in claim 1, 2, 3 or 4 where the substantially symmetrical switching elements electrically connected to respective pixel electrodes comprise subswitching elements.

11. A method as in claim 1, 2, 3 or 4 where the substantially symmetrical switching elements electrically connected to respective pixel electrodes comprise diode rings.

12. A method as in claim 1, 2, 3 or 4 where the polarities of the selection and data voltages are periodically reversed.

13. A method as in claim 12 where the polarities of said voltages are reversed after periods during which at least ten display frames are produced.

14. A method as in claim 1, 2, 3 or 4 where the row electrodes are capacitively coupled to the pixel electrodes.

* * * * *